US010510463B2

(12) United States Patent
Son et al.

(10) Patent No.: US 10,510,463 B2
(45) Date of Patent: Dec. 17, 2019

(54) WAVY METAL NANOWIRE NETWORK THIN FILM, STRETCHABLE TRANSPARENT ELECTRODE INCLUDING THE METAL NANOWIRE NETWORK THIN FILM AND METHOD FOR FORMING THE METAL NANOWIRE NETWORK THIN FILM

(71) Applicant: KOREA INSTITUTE OF SCIENCE AND TECHNOLOGY, Seoul (KR)

(72) Inventors: Jeong Gon Son, Seoul (KR); Sang-Soo Lee, Seoul (KR); Heesuk Kim, Seoul (KR); Jong Hyuk Park, Seoul (KR); Wan Ki Bae, Seoul (KR); Hyo Won Kwon, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 45 days.

(21) Appl. No.: 15/824,135

(22) Filed: Nov. 28, 2017

(65) Prior Publication Data

US 2019/0006061 A1 Jan. 3, 2019

(30) Foreign Application Priority Data

Jun. 29, 2017 (KR) ..... 10-2017-0082672

(51) Int. Cl.

| | |
|---|---|
| ***H01B 5/14*** | (2006.01) |
| ***H01B 13/00*** | (2006.01) |
| ***H01B 1/22*** | (2006.01) |

(52) U.S. Cl.

CPC ..... *H01B 5/14* (2013.01); *H01B 1/22* (2013.01); *H01B 13/0036* (2013.01)

(58) Field of Classification Search

CPC ..... H05K 1/00

See application file for complete search history.

(56) References Cited

U.S. PATENT DOCUMENTS

2010/0002402 A1* 1/2010 Rogers ..... H01L 21/4867 361/749

FOREIGN PATENT DOCUMENTS

KR 10-2014-0007589 A 1/2014
KR 10-1630817 B1 6/2016

OTHER PUBLICATIONS

Ko et al., Strechable Ag electrodes with mechanically tunable optical trasnmittance on wavy-patterned PDMS substrates, Apr. 24, 2017 , https://www.nature.com/articles/srep46739 (Year: 2017).*

(Continued)

*Primary Examiner* — Dah-Wei D. Yuan
*Assistant Examiner* — Andrew J Bowman
(74) *Attorney, Agent, or Firm* — Rabin & Berdo, P.C.

(57) ABSTRACT

A wavy metal nanowire network thin film, a stretchable transparent electrode including the metal nanowire network thin film, and a method for forming the metal nanowire network thin film. More specifically, it relates to a wavy nanowire network structure based on straight metal nanowires, a method for producing the nanowire network structure, and a flexible electrode including the wavy metal nanowire structure. The flexible electrode of the present invention is transparent and stretchable and exhibits stable performance even when subjected to various deformations.

4 Claims, 3 Drawing Sheets

(56) References Cited

OTHER PUBLICATIONS

Seung Yoon Ryu et al., "Lateral Buckling Mechanics in Silicon Nanowires on Elastomeric Substrates", Nano Letters, 2009, pp. 3214-3219, vol. 9, No. 9.
Byoung Soo Kim et al., "Biaxial Stretchability and Transparency of Ag Nanowire 2D Mass-Spring Networks Prepared by Floating Compression", ACS Appl. Mater. Interfaces, 2017, pp. 10865-10873, vol. 9.
Jun Beom Pyo et al., "Floating compression of Ag nanowire networks for effective strain release of stretchable transparent electrodes", Nanoscale, 2015, pp. 16434-16441, vol. 7.

* cited by examiner

WAVY METAL NANOWIRE NETWORK THIN FILM, STRETCHABLE TRANSPARENT ELECTRODE INCLUDING THE METAL NANOWIRE NETWORK THIN FILM AND METHOD FOR FORMING THE METAL NANOWIRE NETWORK THIN FILM

CROSS-REFERENCE TO RELATED APPLICATIONS

This application claims priority under 35 U.S.C. § 119 to Korean Patent Application No. 10-2017-0082672 filed on Jun. 29, 2017 in the Korean Intellectual Property Office, the disclosure of which is incorporated herein by reference in its entirety.

BACKGROUND OF THE INVENTION

1. Field of the Invention

The present invention relates to a wavy metal nanowire network thin film, a stretchable transparent electrode including the metal nanowire network thin film, and a method for forming the metal nanowire network thin film. More specifically, the present invention discloses a wavy nanowire network structure based on straight metal nanowires, a method for producing the nanowire network structure, and a flexible electrode including the wavy metal nanowire structure. The flexible electrode of the present invention is transparent and stretchable and exhibits stable performance even when subjected to various deformations.

2. Description of the Related Art

The market for smart devices and IT devices continues to grow rapidly. In recent years, deformability, flexibility, stretchability, and foldability have become new trends in electronic products. Thus, there has been an increasing demand for various types of electronic devices and materials that can exhibit the above functions. Flexible, deformable, stretchable electronic device technologies are expected to be widely applicable to the field of robots and wearable electronic devices as well as flexible electronic devices, typified by displays, touch panels, transistors, and solar cells, in the future. Such flexible and deformable electronic devices most fundamentally require the use of transparent electrodes that can be stretched in response to conformational changes of materials, particularly, electrodes that exhibit high transmittance and have useful electrical and mechanical properties even when stretched or compressed.

Indium tin oxide (ITO) is currently used as a major material for transparent electrodes. However, ITO, whose conformation is difficult to change, tends to be brittle, limiting its application to flexible electronic devices. In attempts to overcome these disadvantages, various proposals have been made in the literature for the use of graphene, carbon nanotubes, and metal nanowires, and bonding therebetween. Particularly, materials based on metal nanowires are considered the most suitable for flexible transparent electrodes because of their outstanding electrical properties and high transmittance. For example, Korean Patent Publication No. 10-2014-0109835 discloses adhesion between metal nanowires and a flexible material. Mechanical properties of materials are generally determined by their inherent characteristics (e.g., Young's modulus). Thus, efforts to improve the characteristics of materials through additional processes are of great technical significance.

However, most studies on stretchable electrodes using metal nanowires have focused on solving problems caused by contact between the nanowires and adhesion between electrodes and substrates or problems associated with oxidation to achieve improved performance. Indeed, little research has been conducted on the structural improvement of essentially straight metal nanowires to make the metal nanowires more suitable for use in stretchable and flexible electrodes.

Under these circumstances, the present inventors have found that a wavy metal nanowire network thin film can be used to manufacture a transparent, stretchable, flexible electrode that exhibits stable performance even when subjected to various deformations. The present invention has been accomplished based on this finding.

PRIOR ART DOCUMENTS

Patent Documents

Patent Document 1: Korean Patent No. 10-1630817

Non-Patent Documents

Non-patent Document 1: Kim, Byoung Soo, et al. ACS Applied Materials & Interfaces 9.12 (2017): 10865-10873

Non-patent Document 2: Pyo, Jun Beom, et al. Nanoscale 7.39 (2015): 16434-16441

SUMMARY OF THE INVENTION

The present invention has been made in view of the above-mentioned problems, and it is an object of the present invention to provide a wavy metal nanowire network thin film and a transparent, stretchable, flexible electrode using the metal nanowire network thin film that exhibits stable performance even when subjected to various deformations.

One aspect of the present invention provides a wavy metal nanowire network structure including a stretchable substrate and a wavy metal nanowire network thin film formed on the stretchable substrate wherein the wavy metal nanowires have an average diameter of 10 to 100 nm and a length of 10 μm or more and the wavy metal nanowire network has a radius of curvature of 1 to 100 μm and is curved in parallel to the substrate.

A further aspect of the present invention provides a stretchable electrode including the wavy metal nanowire network structure.

Another aspect of the present invention provides a method for forming a wavy metal nanowire network thin film, including (a) stretching a stretchable substrate, (b) forming a metal nanowire network on the stretched substrate, (c) bringing a solvent into contact with the metal nanowire network formed on the substrate, and (d) releasing the strain applied to the substrate in a state in which the metal nanowire network and the solvent are in contact with each other.

The stretchable electrode manufactured using the wavy metal nanowire network thin film is transparent and flexible and exhibits stable performance even when subjected to various deformations.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE INVENTION

Figure 1:
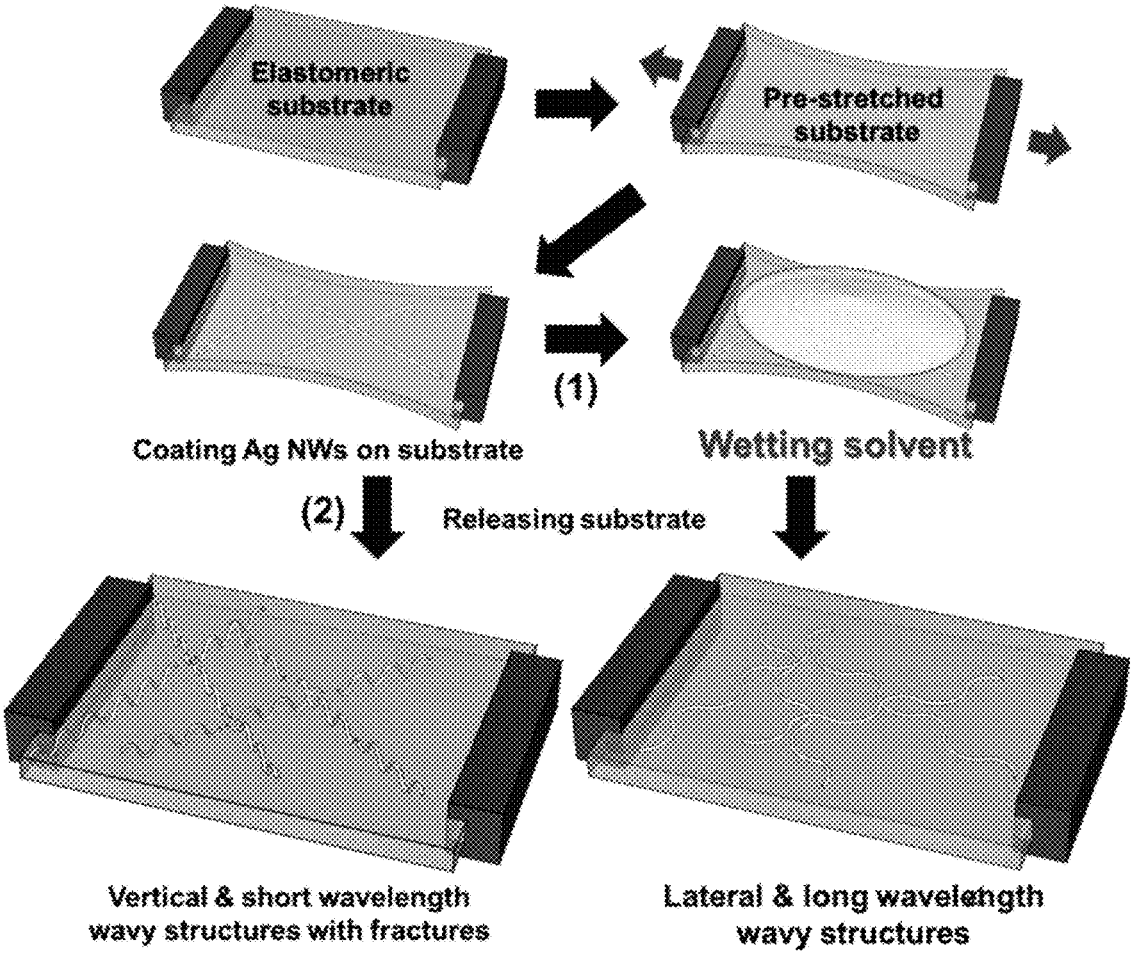
FIG. 1 schematically shows the formation of a wavy metal nanowire network thin film in Example 1.

Several aspects and various embodiments of the present invention will now be described in more detail.

One aspect of the present invention is directed to a wavy metal nanowire network structure including a stretchable substrate and a wavy metal nanowire network thin film formed on the stretchable substrate wherein the wavy metal nanowires have an average diameter of 10 to 100 nm and a length of 10 μm or more and the wavy metal nanowire network has a radius of curvature of 1 to 100 μm and is curved in parallel to the substrate.

Since the wavy metal nanowire network is curved with a radius of curvature of up to 100 μm on the stretchable substrate, the conductivity of the structure is stable against various deformations.

A further aspect of the present invention is directed to a stretchable electrode including the wavy metal nanowire network structure.

The stretchable electrode of the present invention is highly conductive and stretchable due to the presence of the wavy metal nanowire network structure.

Another aspect of the present invention is directed to a method for forming a wavy metal nanowire network thin film, including (a) stretching a stretchable substrate, (b) forming a metal nanowire network on the stretched substrate, (c) bringing a solvent into contact with the metal nanowire network formed on the substrate, and (d) releasing the strain applied to the substrate in a state in which the metal nanowire network and the solvent are in contact with each other.

The wavy configuration of the metal nanowires allows the thin film to exhibit stable stretchability as a whole despite various deformations while ensuring transparency. Due to these advantages, the thin film may be of great utility in flexible electrodes. That is, the wavy configuration of the metal nanowires is effective in stress dispersion and ensures high stretchability of the thin film above the inherent limited stretchability of straight metal nanowires. In other words, the curved metal nanowire network has a geometric structure such that it is resistant to severe external changes (e.g., strain and stretching), which is difficult to achieve by straight metal nanowires.

In step (d), a solvent is brought into contact with the network of straight metal nanowires formed in step (b) to impart flowability to contact portions between the nanowires. As a result, when the strain applied to the substrate is released, slipping between the nanowire strands is induced, causing a significant increase in the radius of curvature of the nanowire strands in a direction parallel to the substrate.

According to one embodiment of the present invention, the stretchable substrate may be a transparent one.

According to a further embodiment of the present invention, the stretchable substrate may be made of polydimethylsiloxane, polyurethane, very high bond (VHB), polypyrrole, polyacetylene, polyaniline, polythiophene, polyacrylonitrile, polyethylene terephthalate, polycarbonate, polyimide, polyether sulfone, polyarylate, polystyrene, polypropylene, polyethylene naphthalate, polymethylmethacrylate, Ecoflex®, silicone rubber or a mixture of two or more thereof. However, the material for the stretchable substrate is not limited. Preferably, the stretchable substrate is made of polydimethylsiloxane.

According to another embodiment of the present invention, in step (a), the stretchable substrate may be stretched in a horizontal direction. A tensile device may be used to horizontally stretch the stretchable substrate. Both ends of the stretchable substrate are clamped by the tensile device and the stretchable substrate is stretched by a predetermined area.

According to another embodiment of the present invention, in step (a), the stretchable substrate may be stretched to 105% to 200% of its initial area.

When the area defined between the clamped both ends of the stretchable substrate is defined as an initial area, the stretchable substrate is stretched to 105% to 200%, preferably 130% to 170% of its initial area. As the stretched area increases in proportion to the initial area, the waviness of the metal nanowires increases.

According to another embodiment of the present invention, the metal nanowires may further include an organic material, an inorganic material or a mixture thereof.

The metal nanowires may also form complexes with an organic material, an inorganic material or a mixture thereof. Herein, the complexes refer to mixtures or reaction products obtained by mixing or reacting the metal nanowires with the organic material and/or the inorganic material. The organic material or the inorganic material improves the physical properties of the metal nanowires. When the metal nanowires are mixed with graphene or carbon nanotubes, the adhesive strength between the metal nanowires and the electrical properties of the metal nanowires can be improved. However, there is no restriction on the kind of the organic material or the inorganic material.

According to another embodiment of the present invention, the metal may be selected from, but not limited to, Ag, Ni, Co, Fe, Pt, Au, Al, Cr, Cu, Mg, Mn, Mo, Rh, Si, Ta, Ti, W, U, V, Zr, Ge, and mixtures of two or more thereof. Ag is preferably used as the metal.

According to another embodiment of the present invention, in step (b), a metal nanowire network may be formed on the substrate by spray coating, spin coating, doctor blade coating or inkjet printing. Alternatively, a metal nanowire network may be formed by transferring an as-prepared nanowire network to the substrate.

An as-prepared nanowire network may be transferred to the substrate by a method including (b1) forming a metal nanowire network on a first substrate and (b2) bringing the metal nanowire network formed on the first substrate into direct contact with the stretchable substrate stretched in step (A) to transfer the metal nanowire network to the stretchable substrate.

Specifically, the first substrate may be a non-porous or porous film and step (b1) may be carried out by (b1') coating metal nanowires on a non-porous or porous film or (b1") filtering metal nanowires on a porous film.

The coating may be performed by spray coating or doctor blade coating and the filtration may be performed under vacuum.

Step (b2) may be carried out by bringing the metal nanowire network formed on the first substrate into direct contact with the surface of the stretched stretchable substrate, putting a sufficient amount of a solvent on the back surface of the first substrate, and transferring the metal nanowire network to the stretchable substrate.

The transfer is performed after complete drying of the first substrate and the metal nanowire network.

According to another embodiment of the present invention, the solvent may have a surface tension of 20 to 85 $J/m^2$.

According to another embodiment of the present invention, the solvent may be water or a mixture of water and an organic solvent, and the organic solvent may be selected from, but not limited to, acetone, acetonitrile, acetaldehyde, acetic acid, acetophenone, acetyl chloride, acrylonitrile, aniline, benzyl alcohol, 1-butanol, n-butyl acetate, cyclohexanol, cyclohexanone, 1,2-dibromoethane, diethyl ketone, N,N-dimethylacetamide, N,N-dimethylformamide, dimethyl sulfoxide, 1,4-dioxane, ethanol, ethyl acetate, ethyl formate, formic acid, glycerol, hexamethylphosphoramide, methyl acetate, methyl ethyl ketone, methyl isobutyl ketone, N-methyl-2-pyrrolidone, methanol, nitrobenzene, nitromethane, 1-propanol, propylene-1,2-carbonate, tetrahydrofuran, tetramethylurea, triethyl phosphate, trimethyl phosphate, ethylenediamine, and mixtures of two or more thereof. Water is preferably used as the solvent.

According to another embodiment of the present invention, in step (c), a solvent may be brought into contact with the surface of the substrate by dropping or spraying. Alternatively, the substrate may be immersed in a solvent to bring the solvent into contact with the substrate.

According to another embodiment of the present invention, in step (d), the strain applied to the substrate may be released at a rate of 0.01 to 10 mm/s.

Particularly, when the stretchable substrate is stretched to 105 to 200% of its initial area and the release rate of the strain is in the range defined above, the resistance value of the metal nanowire network thin film is maintained constant even after 2000 or more repeated cycles of stretching. In contrast, if either the increased area of the stretchable substrate or the release rate of the strain is outside the corresponding numerical range, the resistance value of the metal nanowire network thin film is not maintained constant after 2000 or more repeated cycles of stretching.

According to another embodiment of the present invention, the metal nanowire network thin film may have a thickness of 10 to 500 nm.

Particularly, the thickness of the metal nanowire layer formed on the porous film by coating or filtration is preferably adjusted to the range of 10 nm to 100 nm. If the thickness of the metal nanowire thin film formed on the porous film is less than the lower limit or exceeds the upper limit, the initial stretchability of the final metal nanowire thin film deteriorates considerably.

The nanoscale dimensions of the wavy metal nanowire network thin film explain its low surface energy, making it easy to attach the metal nanowire network to substrates made of various materials and to transfer the metal nanowire network even to substrates having curved surfaces.

Although not explicitly presented in the Examples section that follows, wavy metal nanowire network thin films were produced by varying the kinds of the stretchable substrate, the metal, and the solvent, the stretching mode and the increased area of the stretchable substrate in step (a), the formation mode of the metal nanowire network in step (b), the contact mode of the solvent in step (c), and the strain release rate in step (d), the torsional strengths of stretchable electrodes manufactured using the metal nanowire network thin films were measured, and the durabilities of the stretchable electrodes were evaluated by comparing the electrical conductivities of the stretchable electrodes after 300 cycles of torsion with their initial values.

As a result, metal nanowire networks satisfying the following requirements were not fractured even after 300 cycles of torsion and the initial electrical conductivities of stretchable electrodes manufactured using the metal nanowire networks and their electrical conductivities after 300 cycles of torsion showed the same values within the error range of an electrical conductivity meter, indicating their excellent durabilities, unlike when other kinds of stretchable substrates, metals, and solvents, other modes of implementation, and other numerical ranges were chosen.

(i) Polydimethylsiloxane was used as a material for the stretchable substrate, (ii) Ag was used as the metal, (iii) water was used as the solvent, (iv) the stretchable substrate was stretched horizontally in step (a), (v) the stretchable substrate was stretched to 130 to 170% of its initial area in step (a), (vi) an as-prepared nanowire network was transferred to the substrate in step (b), (vii) the solvent was brought into contact with the surface of the substrate by dropping in step (c), and (viii) the strain was released at a rate of 0.1 to 6 mm/s in step (d).

If any one of the above requirements was not satisfied, the resulting metal nanowire networks were fractured during measurement of torsional strength and the conductivities of stretchable electrodes manufactured using the metal nanowire networks after 300 cycles of torsion were significantly low compared to their initial values.

The present invention will be explained in more detail with reference to the following examples. However, these examples are not to be construed as limiting or restricting the scope and disclosure of the invention. It is to be understood that based on the teachings of the present invention including the following examples, those skilled in the art can readily practice other embodiments of the present invention whose experimental results are not explicitly presented. It will also be understood that such modifications and variations are intended to come within the scope of the appended claims.

Example 1

Silver nanowires (average diameter 115 nm, average length 35 μm, Seashell technologies) were dispersed in ethanol to a concentration of 5.5 μg Ag/mL ethanol. 15 μL of the dispersion was diluted with 60 mL of ethanol. 60 mL of the dilute dispersion of the silver nanowires was filtered under vacuum on an AAO membrane (anodized aluminum oxide, average pore size 100 nm, Whatman) to form a silver nanowire layer. During drying of the AAO membrane formed with the silver nanowire layer, a PDMS substrate was clamped by a tensile device such that the distance between the clamped both ends of the substrate was 4 cm. The PDMS substrate was firmly fixed to the tensile device to prevent it from being separated from the tensile device and was stretched to 6 cm, which is larger by 50% of its initial distance. The AAO membrane formed with the silver nanowire layer was attached to the stretched PDMS such that the silver nanowire layer came into contact with the PDMS substrate. Water was put on the AAO membrane to wet the AAO membrane. After removal of the AAO membrane, the transferred silver nanowires were dried at room temperature to remove remaining water after transfer. A sufficient amount of water was again put on the silver nanowires and allowed to wet the silver nanowires for 1.5 min. The strain applied to the PDMS substrate was released to obtain wavy silver nanowires. The resulting silver nanowire layer is shown in FIG. 2B.

Comparative Example 1

In accordance with the same procedure as described in Example 1, 15 μL of a dispersion of silver nanowires was used to form on a silver nanowire layer on an AAO membrane and the AAO membrane formed with the silver nanowire layer was placed on a pre-stretched PDMS substrate to transfer the silver nanowires on the PDMS substrate. After water used during transfer was completely removed by drying, the strain applied to the PDMS substrate was released. The resulting silver nanowire layer is shown in FIG. 2A.

Evaluation Example 1 and Comparative Evaluation Example 1

The surface morphologies of the silver nanowire layers formed on the stretchable substrates in Example 1 and Comparative Example 1 were observed under a scanning electron microscope. The results are shown in FIG. 2A (Comparative Example 1) and FIG. 2B (Example 1).

Figure 2A:
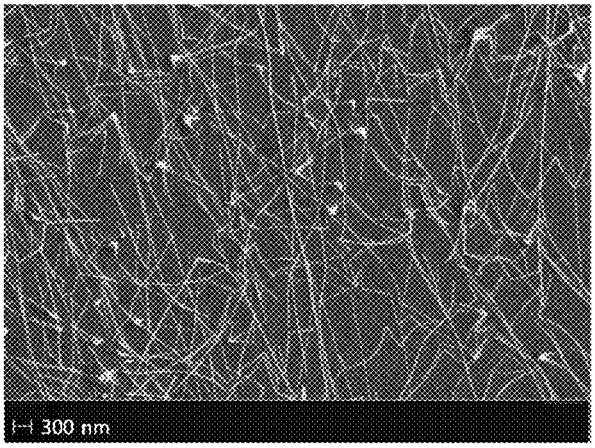
FIGS. 2A and 2B show field emission scanning electron microscopy images of metal nanowire structures on stretchable substrates that were produced in Comparative Example 1 (FIG. 2A) and Example 1 (FIG. 2B)
Figure 2B:
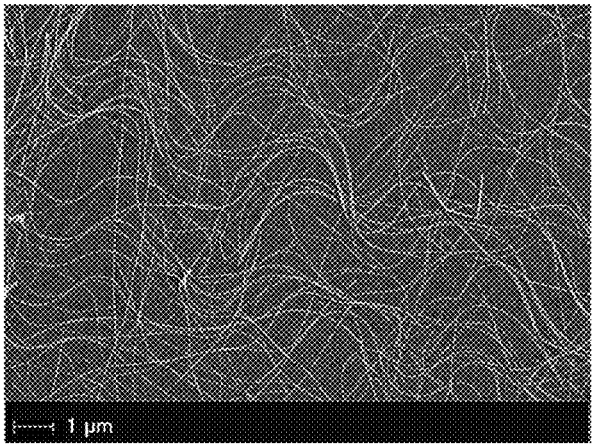

In Comparative Example 1, the nanowires were cut, as shown in FIG. 2A, when the strain was released in a state in which a solvent was not in contact with the silver nanowire layer after pre-stretching and nanowire coating. In Example 1, the strain was released in a state in which the solvent was in contact with the silver nanowire layer after pre-stretching and nanowire coating in Example 1, and as a result, a network of the curved nanowires was observed, as shown in FIG. 2B.

As shown in FIG. 2B, the nanowire network layer was made more curved by the compressive deformation (i.e. the release of the strain applied to the substrate) in a state in which the silver nanowire layer was sufficiently wetted with water. In addition, the curved nanowire network had a large radius of curvature in a direction horizontal to the substrate.

Evaluation Example 2 and Comparative Evaluation Example 2

Each of the PDMS substrates (1.5 cm×2.5 cm) formed with the silver nanowire layers in Example 1 and Comparative Example 1 was fixed on a tensile machine (Kistech, Korea) capable of measuring resistance values while stretching the substrate. Then, the resistance values of the fixed specimen were measured during stretching. A gallium-Indium eutectic (Sigma Aldrich) known as a liquid metal was applied to both ends of the specimen, which were used as working electrodes. Until the material was stretched by 50%, the resistance values were recorded every 10% (see FIGS. 3A and 3B).

Figure 3A:
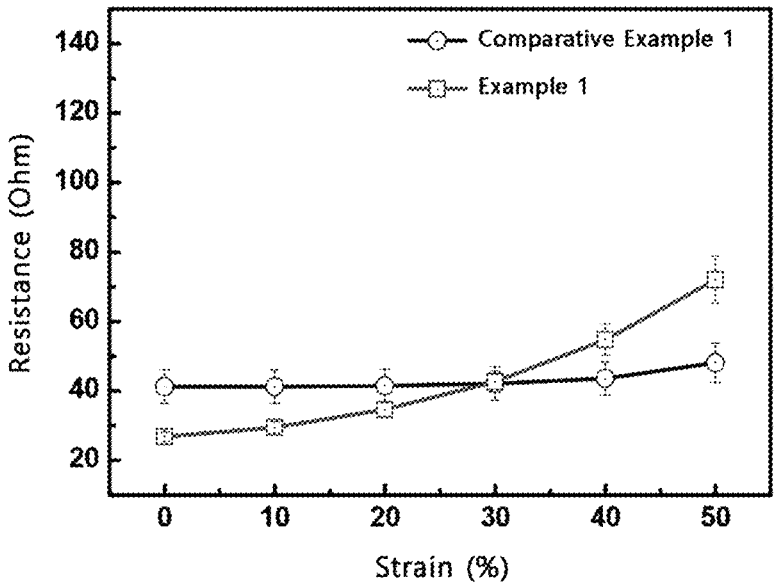
FIG. 3A shows resistance variations of metal nanowire layers formed on stretchable substrates when the stretchable substrates were deformed and FIG. 3B shows resistance variations of the metal nanowire layers during 1000 cycles of deformation, which were measured in Evaluation Example 2 and Comparative Evaluation Example 2.
Figure 3B:
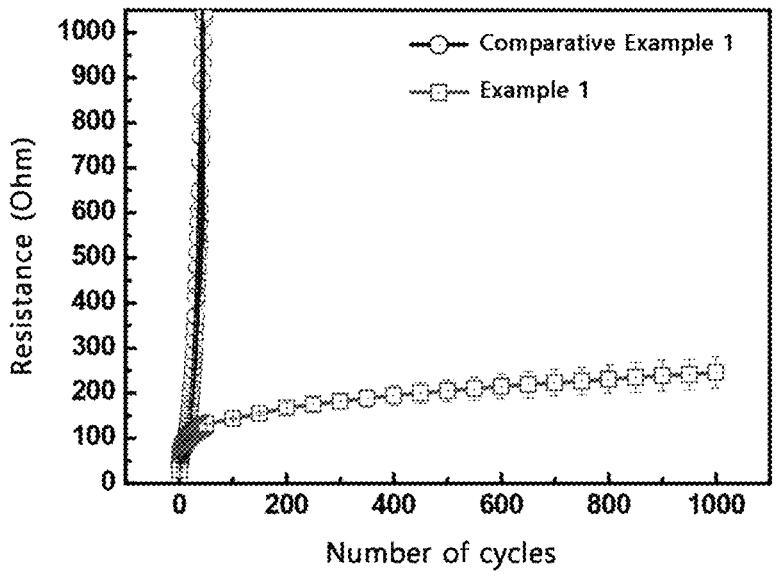

The smoothly curved silver nanowire structure formed on the PDMS substrate (Example 1) was expected to show more stable resistance values over the entire strain range than the sharp silver nanowires (Comparative Example 2), but results contrary to the expectation were obtained at low strains (FIG. 3A).

Each of the materials was stretched by 50% and was returned to its original form. This procedure was repeated a total of 1000 times. The resistance value was measured at each cycle. In the repeated tensile tests, the resistance values of the curved silver nanowire structure formed on the PDMS substrate (Example 1) were maintained more constant than those of the straight silver nanowires (Comparative Example 1), shown in FIG. 3B.

What is claimed is:

1. A method for forming a wavy metal nanowire network thin film, comprising:

(a) stretching a stretchable substrate, (b) forming a metal nanowire network on the stretched substrate, (c) bringing a solvent into contact with the metal nanowire network formed on the substrate, and (d) releasing the strain applied to the substrate in a state in which the metal nanowire network and the solvent are in contact with each other, wherein, the stretchable substrate is made of polydimethylsiloxane, a metal of the metal nanowire network is Ag, the solvent is water, the stretchable substrate is stretched horizontally in step (a), the stretchable substrate is stretched to 130 to 170% of its initial area in step (a), an as-prepared nanowire network is transferred to the substrate in step (b), the solvent contacts with the surface of the substrate by dropping in step (c), the strain is released at a rate of 0.1 to 6 mm/s in step (d), and the wavy metal nanowire network thin film has a thickness of 10 to 500 nm.

2. The method according to claim 1, wherein the stretchable substrate is transparent.

3. The method according to claim 1, wherein, in step (b), a metal nanowire network is formed on the substrate by spray coating, spin coating, doctor blade coating or inkjet printing or by transferring an as-prepared nanowire network to the substrate.

4. The method according to claim 1, wherein the solvent has a surface tension of 20 to 85 $J/m^2$.

* * * * *